United States Patent [19]

Schulz

[11] Patent Number: 4,934,911

[45] Date of Patent: Jun. 19, 1990

[54] HYDRAULIC ROTARY PISTON ENGINE HAVING INPROVED COMMUTATOR VALVE

[75] Inventor: Ewald Schulz, Neuhuetten, Fed. Rep. of Germany

[73] Assignee: Mannesmann Rexroth Gmbh, Fed. Rep. of Germany

[21] Appl. No.: 172,629

[22] Filed: Mar. 24, 1988

[30] Foreign Application Priority Data

Apr. 1, 1987 [DE] Fed. Rep. of Germany ..... 3710817

[51] Int. Cl.[5] ..... F03C 2/08

[52] U.S. Cl. ..... 418/61.3; 137/625.23

[58] Field of Search ..... 418/61.3; 137/625.23

[56] References Cited

U.S. PATENT DOCUMENTS

| | | | |
|---|---|---|---|
| 3,087,436 | 4/1963 | Dettlof et al. | 418/61.3 |
| 3,473,437 | 10/1969 | Ohrberg | 418/61.3 X |
| 3,819,307 | 6/1974 | Uppal | 418/61.3 |
| 4,106,883 | 8/1978 | Hansen et al. | 418/61.3 |
| 4,362,479 | 12/1982 | Pahl | 418/61.3 |
| 4,451,217 | 5/1984 | White | 418/61.3 X |
| 4,671,747 | 6/1987 | Arbterg | 418/61.3 |

FOREIGN PATENT DOCUMENTS

| | | |
|---|---|---|
| 1293601 | 12/1969 | Fed. Rep. of Germany . |
| 1906445 | 3/1970 | Fed. Rep. of Germany . |
| 2107493 | 2/1973 | Fed. Rep. of Germany . |
| 1553004 | 1/1974 | Fed. Rep. of Germany . |
| 2608887 | 9/1982 | Fed. Rep. of Germany . |
| 425094 | 9/1947 | Italy . |

*Primary Examiner*—John J. Vrablik

*Attorney, Agent, or Firm*—Martin Lukacher

[57] ABSTRACT

A rotary piston engine having a commutator valve in a cooperating connection with the output shaft so as to supply and remove pressure medium to and from tooth chambers. Said engine further comprises passages which end adjacent to the commutator valve in ellipse shaped control openings. The commutator valve is integrally formed with the output shaft and all control channels are in the outer circumference of the commutator valve in the form of grooves which are parallel to the axis. Lands are provided between said grooves. The width of the lands defining said grooves is selected such that the width of the lands changes alternately, one land having a width approximately corresponding to the smaller width of the control ellipse, while the alternate land has a width which is increased by an oversize over the width of the smaller width of said control ellipse.

3 Claims, 4 Drawing Sheets

HYDRAULIC ROTARY PISTON ENGINE HAVING INPROVED COMMUTATOR VALVE

TECHNICAL FIELD

The invention relates to a rotary piston engine, and in particular to a gear ring engine. The present invention relates to the use of gear ring engines as pumps as well as motors.

BACKGROUND ART

A gear ring engine comprises a stationary outer ring and a rotor, said outer ring having teeth means at its inside, for example seven teeth, while said rotor is provided with outer teeth means, comprising for instance six teeth. The inner teeth of the outer ring can be formed by rollers. The teeth are designed such that a sealing effect occurs between the outer ring and the rotor. One half of the discplacement or gear chambers which are created between the outer ring and the rotor are connected to the high pressure side of the engine, while the other half is connected with the low pressure side. A rotating distributor valve (commutator valve) serves to control the engine. During the movement of one of the teeth of the rotor from one tooth gap of the outer ring to the next tooth gap, each tooth or gear chamber is filled and discharged once.

German patent 12 93 601 discloses a rotary piston engine having a distributor valve in which radially extending control channels and also control channels in the form of axially extending grooves are provided. Passages formed in the housing are connected with said control channels, said passages ending on one side into a bore of the housing and are connected at the other side with the gear chambers. Moreover, a ring channel is provided in the housing which is connected with the control channels having the form of grooves. The radially extending control channels lead on the other hand into the interior of a distributor valve and provide via the inner space of the rotary valve the connection to another ring channel in the housing. The ring channels located in the housing are in turn connected with bores of the housing so as to provide a connection to pressure medium. For the production of such a pump a significant amount of expenditures is required. Also, when running the engine a high level of noise is observed.

German patent 26 08 887 relates to a rotary piston engine for a liquid. In a main distributor valve of said engine control openings are provided which extend obliquely with a small angle of a approximately 3° to 8° with respect to the line of circumference of the appropriate control surface, wherein the control openings are sized such that control openings connected to the compression chambers are approximately exactly covered by each second sealing land (of the sealing lands which remain between the other control opening, while the control openings will be covered by the sealing lands arranged inbetween with excess (oversize). Due to these features pressure jolts in the connecting conduits are to be avoided without requiring any additional machining. In this context attention is drawn to Italian patent 425094 which discloses in FIG. 5 roof and kidney shaped passages which provide for the same effect as the oblique control openings. Page 1, lines 58 through 70 of said Italian patent notes that the selected cross section successively increases the power, so that the full cross section will not open in a shock-line manner.

It is an object of the present invention to design a rotary piston engine of the kind mentioned initially, that a simple and thus costwise favorable manufacture can be achieved without using complicated machining operations, and without having to renounce the advantages of a minimal generation of noise during operation of the engine.

DISCLOSURE OF THE INVENTION

In accordance with the present invention a rotary piston engine for a liquid working medium is provided. Said engine can be used as a pump or a motor. The housing of the engine forms a first gear or carries rollers which define such a gear. Said first gear, or said rollers forming said gear, surround a second gear which comprises one tooth less than the first gear. The second gear is connected with the output shaft via a linkage shaft. The second gear can carry out relative to the first gear a circulating and a rotating movement, such that between the first and second gears tooth or gear chambers (compression chambers) are formed. A distributor valve (rotating commutator valve) rotates with the output shaft and provides for a connection to the compression chambers. In accordance with the invention grooves are provided in the rotary commutator valve and extend parallel to the longitudinal axis of the housing. The width of the lands existing between said grooves is selected to be different. There will be subsequently arranged a smaller land width followed by a larger land width. The larger land width causes a positive overlap due to an oversize, so that for the maximum size of the compression chamber an ellipse shaped control opening can be fully located with its smaller width within the area of the wide land, and wherein on both sides an oversize is provided. For the minimum size of the compression chamber the ellipse shaped control opening is located with its smaller width almost exactly in the area of a narrow land.

Preferably, for an appropriate position of the rotarty commutator valve the ellipse is completely located in the area of a longitudinal groove, with the larger diameter of said ellipse extending parallel to the grooves which extend in an axially and parallel manner to the commutator valve. Radial grooves are arranged on both sides of said grooves so that appropriate radial grooves are avoided in the housing. All passges which provide the connection between the tooth or gear chambers and the rotary commutatator valve end in the area of the commutator valve in ellipse shaped control openings. Preferably, the passages comprise firstly an oblique bore ending at the rotary commutator valve and secondly an axial bore connected with said oblique bore.

BRIEF DESCRIPTION OF THE DRAWINGS

Additional advantages, objects and details of the invention may be gathered from the description of an embodiment of the invention, and by referring to the accompanied drawings, in which.

Figure 1:
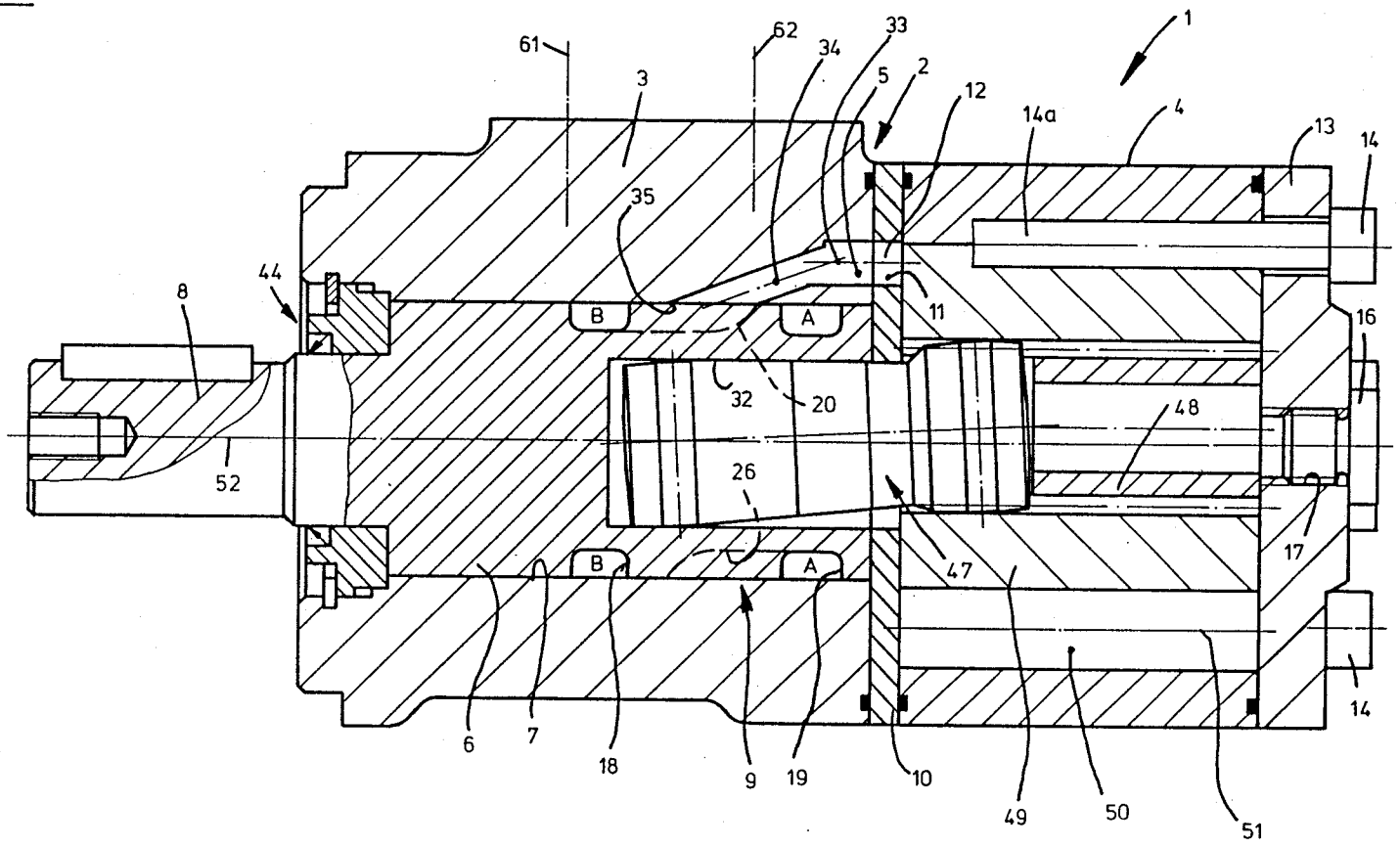
FIG. 1 is a longitudinal sectional view of a gear ring engine.

In connection with FIGS. 1 to 5 a rotary of rotary piston engine is shown in the form of a gear ring engine 1.

Gear ring engines can be used as pumps as well as motors. Predominantly, said gear engines are used as motors. For said reason the following description will occasionally use expressions which are more suitable for the operation of the engine as a motor, even though the invention can be used also in pumps.

The gear ring engine 1 comprises a housing 2 which includes an output shaft housing 3 and a gear ring housing 4.

Within the output shaft housing 3 an output shaft 6 is rotatably supported by means of a bearing and lubricating arrangement 44. Integrally together with the output shaft 6 a rotating distributor valve (commutator valve) 9 is provided.

Between the output shaft housing 3 and the gear ring housing 4 an interim disk 10 is provided which comprises a plurality of openings 12 located on a circle. Sealing means, not referred to, are used together with the interim disk 10. A cover 13 closes the gear ring housing 4. Bolts 14 extend through bores 14a and are screwed into the output shaft housing 3 so as to fixedly mount the output shaft housing 3, the interim disk 10, the gear ring housing 4 and the cover 13 at each other. In said cover 13 a bore 17 is provided into which a plug 16 is screwed.

The distributor valve 9 comprises annular grooves 18 and 19 at the outer circumference of the output shaft 6, said grooves 18 and 19 are spaced with respect to each other along the longitudinal axis 52. The annular groove 18 is connected to a pressure medium port 61 in a manner not shown in detail but schematically referred to in FIG. 1 by a dotted line. For the annular groove 19 the pressure medium port 62 is also schematically shown in FIG. 1 by a dotted line. The annular groove 18 is also referred to by "B" and the annular groove 19 is referred to by "A".

During operation as a pump either annular groove 18 or annular groove 19 will be supplied with pressure medium, preferably a hydraulic liquid, depending on the direction of rotation, and the pressure medium will then be supplied either by ring groove 19 or by ring groove 18 to a user. In case of operation as a motor the pressurized pressure medium will either be supplied to the annular groove 18 or the annular groove 19 depending on the desired direction of rotation.

Figure 2:
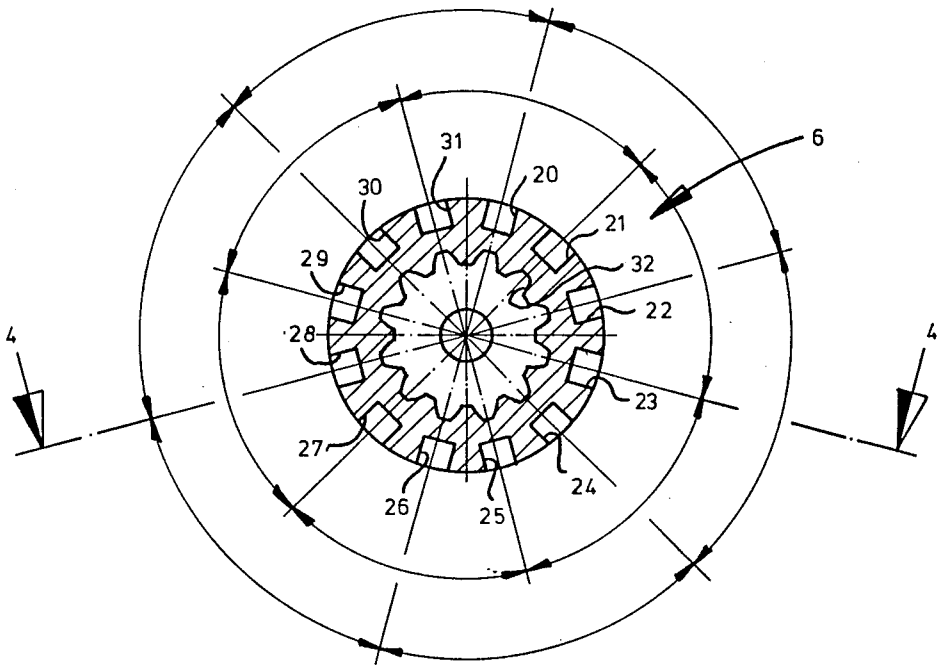
FIG. 2 is a sectional view substantially along line 2—2 in FIG. 3.
Figure 3:
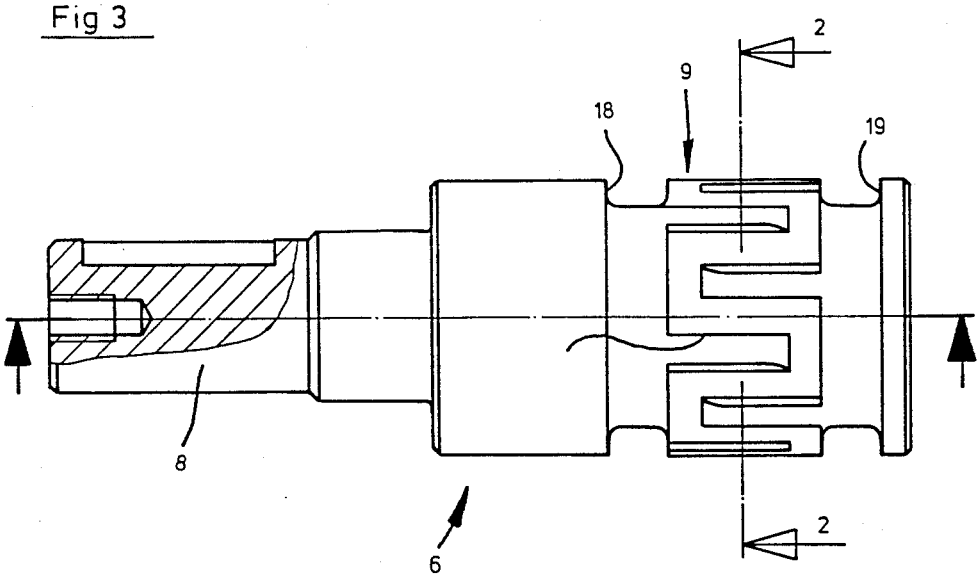
FIG. 3 is a side elevational view of the drive shaft together with an intergrated commutator valve.
Figure 4:
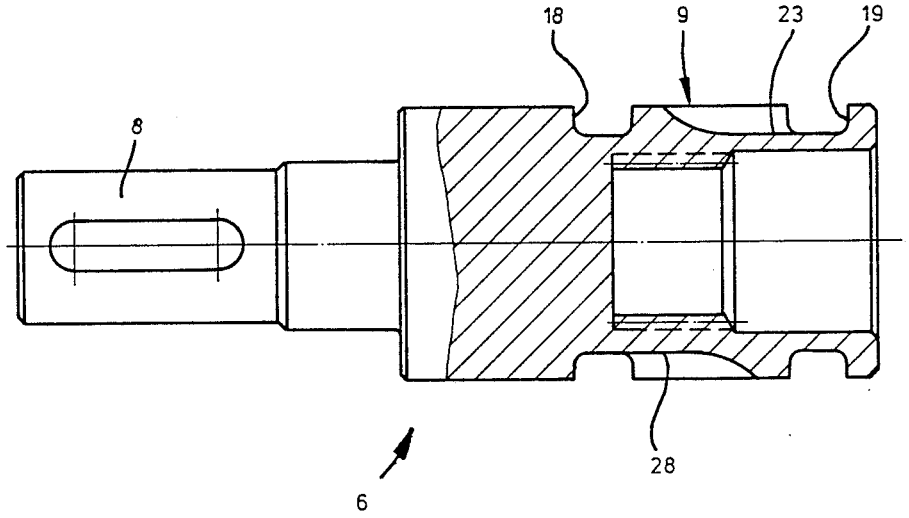
FIG. 4 is a partial section of the commutator valve of FIG. 3.
Figure 5:
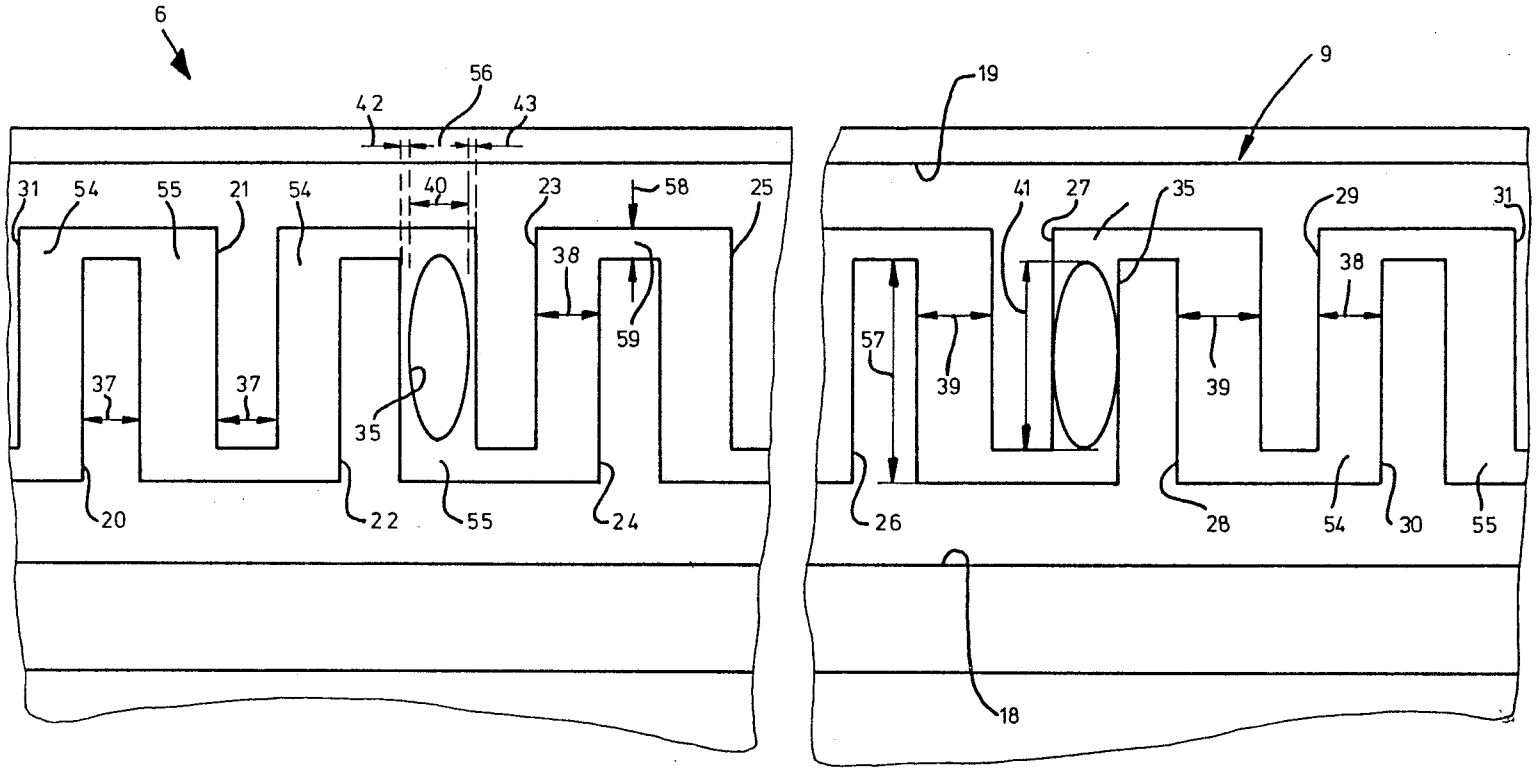
FIG. 5 is a schematic plan view of the commutator valve with only a few of the control openings provided in the housing of the output shaft being shown.

The output shaft 6 together with integral commutator valve 9 is shown in some detail in FIGS. 2, 4 and 5. In the embodiment shown twelve longitudinal grooves 20 through 31 are provided in the outer circumference of the output shaft 6. Said grooves 20 through 31 extend parallel to the longitudinal axis 52. The longitudinal grooves are alternately connected with ring grooves 18 and 19, respectively, as is shown in detail in FIG. 3 through 5.

Within the output shaft 6 a bore 32 is provided and comprises teeth which mesh with the teeth of an articulate shaft 47. The articulate shaft 47 extends into the inner space of the rotor 46, which in turn is rotatably supported in said gear housing 4. The rotor 49 comprises outer teeth means, six teeth are provided but not shown in detail. The outer teeth means of said rotor 49 form together with the inner teeth means of a component surrounding the rotor 49 six tooth or gear chambers (compression chambers) in a known manner. Said tooth chambers are not shown in detail. In the embodiment shown in the drawing the inner teeth are formed by seven rollers representing said teeth, with one roller being shown at reference numeral 50. It is also possible and known to provide the inner circumference of the gear housing 4 with teeth instead of using rollers.

It should be noted that a spacing sleeve 48 is used for supporting the articulate shaft 47 at the cover 13.

As may be recognized in FIG. 1 the output shaft housing 3 comprises altogether seven passages 33 adapted to connect the grooves 22 through 31 with the seven tooth chambers which are formed between the rollers 50 and the outer tooth means of the rotor 49. As was mentioned, in the shown embodiment twelve longitudinal grooves 20 through 31 are provided and likewise seven passages 33 exist. Said passages 33 are also connected with the tooth chambers via seven openings 11 provided in the intermediate disk 10.

The passages 33 which are provided in the output shaft housing 3 each comprise an axially extending bore 5 which is parallel to the longitudinal axis 52 (and which is aligned with an opening 11 in the intermediate disk 10). Further, with said axial bore 5 a control bore 34 is connected which is formed as an oblique bore. Due to the fact that the oblique bore 34 ends at the surface of a circular cylinder an ellipse shaped control opening 35 is created. The control opening 35, which is ellipse shaped in accordance with the invention, will be called for reasons of abbreviation a control ellipse 35. For the embodiment shown seven control ellipses are present two of which are indicated in FIG. 5. At each moment each of said control ellipses 35 is connected via grooves 20 to 31 either with the annular channel 18 or with the annular channel 19, apart from certain special cases which will be discussed below.

Referring specifically to FIG. 5 the design of the rotating commutator valve 9 will be discussed in some detail. The slot width or groove width 37 is preferably the same for all grooves 20 to 31. The lands 54 and 55 existing between the slots or grooves 20 through 31 have a different land width. The lands 54 have a land width 38 and the lands 55 have a land width 39, the latter being larger than the land width 38. Land connections 59 having a land connection width 58 (see FIG. 5) extend between the alternatively narrow and wide lands 54 and 55, respectively. The larger land width 39 is the sum of the smaller land width 38 plus twice the oversize 42 and 43 (see FIG. 5). The oversize 42 and 43 is that amount by which the land width of the land 55 is larger than the smaller diameter 50 of the control ellipse. The larger diameter of the control ellipse is referred to by reference numeral 41. One can recognize in FIG. 5 that the smaller land width 38 corresponds approximately to the smaller diameter 40 of the control ellipse 35.

Preferably, the entire conrol ellipse 35 is located with its entire length within the groove length 57.

Due to the ellipse shaped form of the control openings 35 together with the grooves 20 through 31 extending parallel to the longitudinal axis 52, a gradually increasing or decreasing connection is achieved between the passages 33 and the annular grooves 18 and 19, a situation which leads to a jolt free operation of the motor or pump 1. The desired ellipse shape for the control opening 35 is achieved in a simple manner by using the oblique bore which leads automatically to said ellipse shape. By simultaneously using the control ellipses together with the positive overlap achieved by the oversize shown in FIG. 5 an additional sound reducing effect is obtained, so that the rotary piston engine 1 of the invention provides for an extremely low noise operation.

With regard to the overlap it should be added that FIG. 5 discloses a case of positive overlap where the control ellipse 35 is located in the area of the land betweeen the two slots 22 and 23, a case, where the tooth chamber has its maximum volume. If, however, the tooth chamber has its minimum volume a condition will be present as is shown for the control ellipse 35, which is located between the slots or grooves 27 and 28 in FIG. 5, i.e. the control ellipse fits nearly exactly into the area of the land between groove 27 and 28.

I claim:

1. A rotary piston engine (1), in particular for a liquid pressure medium, said engine comprising:

an engine housing (2), an output shaft (6) rotatably mounted in said housing, tooth chambers formed by a tooth chamber arrangement having an outer gear with teeth or rollers and an inner gear, said inner gear having one tooth less than the outer gear, an articulate shaft for connecting said output shaft and said tooth chamber arrangement, a commutator valve member having a longitudinal axis and being operatively connected to said output shaft so as to allow supply and discharge of pressure medium to and from said tooth chambers, ports (61, 62) in said engine housing (2) for supplying and removing said pressure medium to and from said engine, control channels in said commutator valve member (9) for connecting said ports (61, 62) via passages (33) provided in said engine housing to said tooth chambers, wherein said passages (33) comprise control ellipses which are ellipse shaped control openings (35) adjacent to said commutator valve member (9), each of said control ellipses having a smaller diameter (40) and a larger diameter (41), the latter extending parallel to said longitudinal axis, said commutator valve member (9) being integrally formed with said drive shaft (6), said control channels in the outer circumference of the commutator valve member (9) are provided in the form of grooves (20–31) which extend parallel to said longitudinal axis and with lands formed between said grooves, said longitudianal grooves are alterately connected with ring grooves (18, 19) for supplying and removig said pressure medium, and the width of the lands which border the grooves in a circumferential direction is selected such that alternatively one land (55) has a width corresponding in substance to the smaller width (40) of the control ellipse, and the other land (55) has a width which is increased by an oversize (42, 43) over the smaller width (40) of the control ellipse.

2. The rotary piston engine of claim 1 wherein said larger diamete*r (41) of the control ellipse (35) extends substantially across the entire length (57) of said groove.

3. The rotary piston engine of claim 1 or 2 wherein each of said passages (33) comprises an oblique bore (34) forming the ellipse shaped control opening (35), and a bore (5) extending parallel to the longitudinal axis of said pump (52).

* * * * *